US012637273B2

(12) United States Patent
Thompson

(10) Patent No.: US 12,637,273 B2
(45) Date of Patent: May 26, 2026

(54) CARRIER FOR CONTAINERS

(71) Applicant: Graphic Packaging International, LLC, Atlanta, GA (US)

(72) Inventor: Jon Thompson, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 17 days.

(21) Appl. No.: 18/643,350

(22) Filed: Apr. 23, 2024

(65) Prior Publication Data

US 2024/0351763 A1 Oct. 24, 2024

Related U.S. Application Data

(60) Provisional application No. 63/461,402, filed on Apr. 24, 2023.

(51) Int. Cl.
*B65D 71/36* (2006.01)
*B65B 11/00* (2006.01)

(52) U.S. Cl.
CPC ..... *B65D 71/36* (2013.01); *B65B 11/004* (2013.01); *B65D 2571/00141* (2013.01); *B65D 2571/0016* (2013.01); *B65D 2571/00444* (2013.01); *B65D 2571/0066* (2013.01); *B65D 2571/00728* (2013.01); *B65D 2571/00753* (2013.01); *B65D 2571/00845* (2013.01)

(58) Field of Classification Search
CPC ..... B65D 71/36; B65D 2571/00141; B65D 2571/00444; B65D 2571/00728; B65D 2571/00753; B65D 2571/066; B65B 11/004
USPC ..... 206/427, 434
See application file for complete search history.

(56) References Cited

U.S. PATENT DOCUMENTS

| | | | |
|---|---|---|---|
| 3,128,010 | A | 4/1964 | Forrer |
| 3,156,377 | A | 11/1964 | Wysocki |
| 3,181,727 | A | 5/1965 | Graser |
| 3,270,914 | A | 9/1966 | Graser |

(Continued)

FOREIGN PATENT DOCUMENTS

| | | | |
|---|---|---|---|
| AU | 635354 | B2 | 3/1993 |
| AU | 672134 | B2 | 9/1996 |

(Continued)

OTHER PUBLICATIONS

International Search Report and Written Opinion for PCT/US2024/025781 dated Aug. 26, 2024.

*Primary Examiner* — Steven A. Reynolds
(74) *Attorney, Agent, or Firm* — Andrew N. Claerbout; FisherBroyles, LLP

(57) ABSTRACT

A package comprising a carrier holding a plurality of articles. The carrier can comprise a plurality of panels extending at least partially around an interior of the carrier. The plurality of panels can comprise at least a top panel, a first bottom panel, a second bottom panel, and an end panel. The end panel can at least partially form a closed end of the carrier. The carrier further can comprise a top gusset foldably connected to each of the top panel and the end panel and a bottom gusset foldably connected to each of the first bottom panel and the end panel. The first bottom panel and the second bottom panel can be secured together so that the first bottom panel and the second bottom panel at least partially form a bottom wall opposite to the top panel.

46 Claims, 10 Drawing Sheets

(56) References Cited

U.S. PATENT DOCUMENTS 3,294,280 A 12/1966 Graser
3,398,856 A 8/1968 Graser
3,963,121 A 6/1976 Kipp
4,215,781 A 8/1980 Hans
4,437,606 A 3/1984 Graser
4,597,523 A 7/1986 Schuster
4,901,849 A 2/1990 Wilson
4,925,019 A 5/1990 Ganz
5,180,054 A * 1/1993 Bakx ..... B65D 71/36 206/427
5,297,673 A 3/1994 Sutherland
5,360,104 A 11/1994 Sutherland
5,381,891 A 1/1995 Harris
5,390,784 A * 2/1995 Sutherland ..... B65D 71/36 206/148
5,445,262 A 8/1995 Sutherland
5,472,090 A 12/1995 Sutherland
5,520,283 A 5/1996 Sutherland
5,542,536 A 8/1996 Sutherland
5,551,556 A * 9/1996 Sutherland ..... B65D 71/32 206/427
5,558,212 A 9/1996 Sutherland
5,671,845 A 9/1997 Harris
5,682,995 A 11/1997 Sutherland
D395,007 S 6/1998 Miller
D395,601 S 6/1998 Miller
5,944,253 A 8/1999 Miller
D415,423 S 10/1999 Miller
6,213,293 B1 4/2001 Marco
6,415,917 B1 7/2002 Marco
6,550,616 B2 4/2003 Le Bras
6,564,530 B2 5/2003 Marco
D525,866 S 8/2006 Oliveira
7,677,387 B2 3/2010 Brand
7,699,215 B2 4/2010 Spivey, Sr.
D620,353 S 7/2010 Block
7,806,314 B2 10/2010 Sutherland
8,070,052 B2 12/2011 Spivey, Sr.
8,087,512 B2 1/2012 Brand
8,096,413 B2 1/2012 Coltri De Paula
8,191,761 B2 6/2012 Brand
8,216,118 B2 7/2012 Dunn
8,297,437 B2 10/2012 Smalley
8,317,082 B2 11/2012 May
8,348,142 B2 1/2013 Smalley
8,376,213 B2 2/2013 Brand
8,439,253 B2 5/2013 Requena
8,459,533 B2 6/2013 Requena
8,464,866 B2 6/2013 Sutherland
8,490,785 B2 7/2013 Brand
8,511,463 B2 8/2013 Brand
D689,360 S 9/2013 Adams
8,579,344 B2 11/2013 Yuen
8,631,932 B2 1/2014 Holley, Jr.
8,701,878 B2 4/2014 Spivey, Sr.
8,840,009 B2 9/2014 Spivey, Sr.
8,936,149 B2 1/2015 Smalley
8,955,674 B2 2/2015 Spivey, Sr.
8,955,736 B2 2/2015 Spivey, Sr.
8,978,889 B2 3/2015 Fitzwater
8,978,963 B2 3/2015 Kastanek
8,997,986 B2 4/2015 Spivey, Sr.
9,010,620 B2 4/2015 Sutherland
9,022,217 B2 5/2015 Holley, Jr.
9,022,277 B2 5/2015 Hendricks
9,033,209 B2 5/2015 Fogle
9,073,658 B2 7/2015 Spivey, Sr.
9,126,716 B2 9/2015 Kohler
9,169,050 B2 10/2015 Spivey, Sr.
9,187,206 B2 11/2015 Holley, Jr.
D746,138 S 12/2015 Bernstein
9,199,774 B2 12/2015 Smalley
9,205,939 B2 12/2015 Disrud
9,248,933 B2 2/2016 Spivey, Sr.
9,284,084 B2 3/2016 Schmal
9,315,288 B2 4/2016 Pinkstone
9,376,230 B2 6/2016 Kastanek
9,376,250 B2 6/2016 Spivey, Sr.
9,487,320 B2 11/2016 Holley, Jr.
9,511,894 B2 12/2016 Wilson
9,567,120 B2 2/2017 Spivey, Sr.
9,598,202 B2 3/2017 Oliveira
9,636,882 B2 5/2017 Holley, Jr.
9,669,976 B2 6/2017 Kastanek
9,701,436 B2 7/2017 Holley, Jr.
9,708,112 B2 7/2017 Sutherland
9,776,750 B2 10/2017 May
9,809,348 B2 11/2017 Smalley
9,840,358 B2 12/2017 Oliveira
9,845,182 B2 12/2017 Baldino
9,963,262 B2 5/2018 Smalley
9,969,523 B2 5/2018 Ayerst
D826,711 S 8/2018 Boersma
10,059,485 B2 8/2018 Spivey, Sr.
D845,760 S 4/2019 Oliveira
D854,412 S 7/2019 Smalley
10,384,846 B2 8/2019 Bates
D858,270 S 9/2019 Requena
D867,900 S 11/2019 Thompson
D870,556 S 12/2019 Tart
10,513,367 B2 12/2019 Smalley
10,513,381 B2 12/2019 Nielsen
10,549,875 B2 2/2020 Spivey, Sr.
D881,690 S 4/2020 Smalley
10,610,078 B2 4/2020 Oliveira
D885,887 S 6/2020 Thompson
10,669,061 B2 6/2020 Smalley
D898,565 S 10/2020 Kearns
10,836,550 B2 11/2020 Zacherle
10,961,014 B2 3/2021 Tart
11,014,727 B2 5/2021 Mccree
11,027,904 B2 6/2021 Mccree
11,027,905 B2 6/2021 Ford
11,180,301 B2 11/2021 Smalley
11,192,702 B2 12/2021 Merzeau
D946,416 S 3/2022 Smalley
D946,417 S 3/2022 Gonzalez Manzano
D946,418 S 3/2022 Gonzalez Manzano
D946,419 S 3/2022 Gonzalez Manzano
D946,420 S 3/2022 Gonzalez Manzano
D946,421 S 3/2022 Gonzalez Manzano
11,261,013 B2 3/2022 Smalley
11,273,950 B2 3/2022 Oliveira
11,286,094 B2 3/2022 Gonzalez Manzano
11,305,924 B2 4/2022 Smalley
11,325,739 B2 5/2022 Requena
11,325,764 B2 5/2022 Spivey, Sr.
11,401,095 B2 8/2022 Rosenbrien
11,413,841 B2 8/2022 Boersma
11,420,802 B2 8/2022 Kooc
D966,098 S 10/2022 Gonzalez Manzano
11,492,185 B2 11/2022 Zammit
11,524,827 B2 12/2022 Gungner
D974,923 S 1/2023 Smalley
D983,049 S 4/2023 Mccree
D984,266 S 4/2023 Mccree
D984,279 S 4/2023 Mccree
D984,280 S 4/2023 Mccree
D984,282 S 4/2023 Mccree
11,623,803 B2 4/2023 Thompson
11,628,994 B2 4/2023 Mccree
D993,016 S 7/2023 Holley, Jr.
D993,019 S 7/2023 Pinkstone
D999,056 S 9/2023 Pinkstone
D999,629 S 9/2023 Pinkstone
11,760,533 B2 9/2023 Oliveira
D1,000,290 S 10/2023 Thompson
11,834,235 B2 12/2023 Pinkstone
11,840,387 B2 12/2023 Thompson
D1,015,872 S 2/2024 Pinkstone
11,912,484 B2 2/2024 Gonzalez Manzano
11,919,694 B2 3/2024 Walling
11,958,673 B2 4/2024 Thompson
12,071,291 B2 8/2024 Ford

(56) References Cited

U.S. PATENT DOCUMENTS

| | | | | |
|---|---|---|---|---|
| 12,103,751 | B2 | 10/2024 | Hicks | |
| 12,172,780 | B2 | 12/2024 | Ford | |
| 12,195,256 | B2 | 1/2025 | Ford | |
| D1,063,642 | S | 2/2025 | Hicks | |
| D1,063,643 | S | 2/2025 | Holley, Jr. | |
| D1,063,644 | S | 2/2025 | Holley, Jr. | |
| D1,064,845 | S | 3/2025 | Ford | |
| D1,064,846 | S | 3/2025 | Ford | |
| D1,064,847 | S | 3/2025 | Thompson | |
| D1,064,848 | S | 3/2025 | Thompson | |
| 12,269,656 | B2 | 4/2025 | Holley, Jr. | |
| 12,269,661 | B2 | 4/2025 | Ford | |
| D1,078,489 | S | 6/2025 | Spivey, Sr. | |
| D1,088,899 | S | 8/2025 | Spivey, Sr. | |
| 12,421,016 | B2 | 9/2025 | Weaver | |
| 2003/0192788 | A1 | 10/2003 | Marco | |
| 2004/0226988 | A1 | 11/2004 | Fogle | |
| 2005/0167291 | A1 | 8/2005 | Sutherland | |
| 2005/0269387 | A1 | 12/2005 | Sutherland | |
| 2006/0191811 | A1* | 8/2006 | Fogle | B65D 71/34 206/434 |
| 2006/0237520 | A1* | 10/2006 | Cargile | B65D 71/36 229/103.2 |
| 2006/0255108 | A1 | 11/2006 | Shmagin | |
| 2007/0000980 | A1 | 1/2007 | Oliveira | |
| 2007/0017829 | A1 | 1/2007 | Sutherland | |
| 2007/0017839 | A1 | 1/2007 | Sutherland | |
| 2007/0114151 | A1 | 5/2007 | Auclair | |
| 2007/0158226 | A1 | 7/2007 | Coltri-Johnson | |
| 2007/0227927 | A1 | 10/2007 | Coltri-Johnson | |
| 2007/0241017 | A1 | 10/2007 | Sutherland | |
| 2007/0290026 | A1 | 12/2007 | Kastanek | |
| 2008/0179385 | A1 | 7/2008 | Nikolai | |
| 2008/0257763 | A1 | 10/2008 | Ogg | |
| 2008/0290149 | A1 | 11/2008 | Sweet | |
| 2009/0101526 | A1 | 4/2009 | Sutherland | |
| 2009/0127147 | A1 | 5/2009 | Sutherland | |
| 2009/0250357 | A1 | 10/2009 | Spivey, Sr. | |
| 2010/0072196 | A1 | 3/2010 | Avis | |
| 2010/0089988 | A1 | 4/2010 | Brand | |
| 2010/0133330 | A1 | 6/2010 | Spivey, Sr. | |
| 2010/0224676 | A1 | 9/2010 | Sutherland | |
| 2010/0230312 | A1 | 9/2010 | Sorrentino | |
| 2010/0270367 | A1 | 10/2010 | Brandenburger | |
| 2011/0000799 | A1 | 1/2011 | Gonzalez | |
| 2011/0036902 | A1 | 2/2011 | Smalley | |
| 2011/0068044 | A1 | 3/2011 | Sorrentino | |
| 2011/0226845 | A1 | 9/2011 | Depaula | |
| 2012/0091190 | A1 | 4/2012 | Smalley | |
| 2013/0104500 | A1 | 5/2013 | Depaula | |
| 2013/0292285 | A1 | 11/2013 | Kastanek | |
| 2014/0332429 | A1 | 11/2014 | Boersma | |
| 2015/0114874 | A1 | 4/2015 | Spivey, Sr. | |
| 2015/0266640 | A1 | 9/2015 | Thompson | |
| 2018/0297744 | A1 | 10/2018 | Merzeau | |
| 2019/0210780 | A1* | 7/2019 | Thompson | B65D 5/241 |
| 2019/0225398 | A1 | 7/2019 | Smalley | |
| 2020/0024045 | A1 | 1/2020 | Smalley | |
| 2021/0206555 | A1 | 7/2021 | Spivey, Sr. | |
| 2024/0239580 | A1 | 7/2024 | Ahumada | |
| 2024/0278968 | A1 | 8/2024 | Thompson | |
| 2024/0351763 | A1 | 10/2024 | Thompson | |

FOREIGN PATENT DOCUMENTS

| | | | |
|---|---|---|---|
| CA | 2193089 | C | 10/2008 |
| CA | 2965526 | C | 2/2019 |
| CA | 2965536 | C | 12/2019 |
| CN | 102905988 | A | 1/2013 |
| EP | 0446042 | A1 | 9/1991 |
| EP | 0658487 | | 6/1995 |
| EP | 0656860 | B1 | 3/1999 |
| MX | 9500787 | A | 9/1997 |
| SG | 188560 | A1 | 4/2013 |
| WO | 1997000212 | A1 | 1/1997 |
| WO | 2007130496 | A3 | 3/2008 |
| WO | 2013173431 | A1 | 11/2013 |
| WO | 2020041118 | A1 | 2/2020 |
| WO | 2023150596 | A3 | 9/2023 |
| WO | 2024226469 | A1 | 10/2024 |
| WO | 2025171102 | A1 | 8/2025 |

* cited by examiner

CARRIER FOR CONTAINERS

CROSS-REFERENCED TO RELATED APPLICATIONS

This application claims the benefit of U.S. Provisional Patent Application No. 63/461,402, filed on Apr. 24, 2023.

INCORPORATION BY REFERENCE

The disclosure of U.S. Provisional Patent Application No. 63/461,402, which was filed on Apr. 24, 2023, is hereby incorporated by reference for all purposes as if presented herein in its entirety.

BACKGROUND OF THE DISCLOSURE

The present disclosure generally relates to carriers for holding and dispensing beverage containers and/or other types of articles. For example, a carrier can include locking elements for closing a bottom of the carrier and/or end panels at least partially forming closed ends of the carrier.

SUMMARY OF THE DISCLOSURE

In general, one aspect of the disclosure is directed to a package comprising a carrier holding a plurality of articles. The carrier can comprise a plurality of panels extending at least partially around an interior of the carrier. The plurality of panels can comprise at least a top panel, a first bottom panel, a second bottom panel, and an end panel. The end panel can at least partially form a closed end of the carrier. The carrier further can comprise a top gusset foldably connected to each of the top panel and the end panel and a bottom gusset foldably connected to each of the first bottom panel and the end panel. The first bottom panel and the second bottom panel can be secured together so that the first bottom panel and the second bottom panel at least partially form a bottom wall opposite to the top panel.

In another aspect, the disclosure is generally directed to a carrier for holding a plurality of articles. The carrier can comprise a plurality of panels extending at least partially around an interior of the carrier. The plurality of panels can comprise at least a top panel, a first bottom panel, a second bottom panel, and an end panel. The end panel can at least partially form a closed end of the carrier. The carrier further can comprise a top gusset foldably connected to each of the top panel and the end panel and a bottom gusset foldably connected to each of the first bottom panel and the end panel. The first bottom panel and the second bottom panel can be secured together so that the first bottom panel and the second bottom panel at least partially form a bottom wall opposite to the top panel.

In another aspect, the disclosure is generally directed to a blank for forming a carrier for holding a plurality of articles. The blank can comprise a plurality of panels comprising at least a top panel, a first bottom panel, a second bottom panel, and an end panel. The end panel can be for at least partially forming a closed end of the carrier formed from the blank. The blank further can comprise a top gusset foldably connected to each of the top panel and the end panel and a bottom gusset foldably connected to each of the first bottom panel and the end panel. The first bottom panel and the second bottom panel can be secured together so that the first bottom panel and the second bottom panel at least partially form a bottom wall opposite to the top panel.

In another aspect, the disclosure is directed to a method of forming a package. The method can comprise obtaining a blank comprising a plurality of panels comprising at least a top panel, a first bottom panel, a second bottom panel, and an end panel, a top gusset foldably connected to each of the top panel and the end panel, and a bottom gusset foldably connected to each of the first bottom panel and the end panel. The method further can comprise wrapping the blank at least partially around the plurality of articles to form the package. The wrapping the blank can comprise positioning the end panel to at least partially form a closed end of the carrier and securing the first bottom panel and the second bottom panel together to at least partially form a bottom wall of the carrier opposite to the top pane.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to various features for cartons or carriers that contain articles such as containers, cans, bottles, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes beverage containers (e.g., beverage cans, glass and/or other bottles, food cans, etc.) as disposed within the carrier embodiments. In this specification, the terms “inner,” “interior,” “outer,” “exterior,” “lower,” “bottom,” “upper,” and "top" indicate orientations determined in relation to fully erected and upright cartons. As described herein, constructs can be formed with multiple walls, panels, portions, tabs, flaps, and/or other aspects, which may be designated herein in terms relative to one another, e.g., "first," "second," "third," etc., in sequential or nonsequential reference, without departing from the disclosure.

Figure 1:
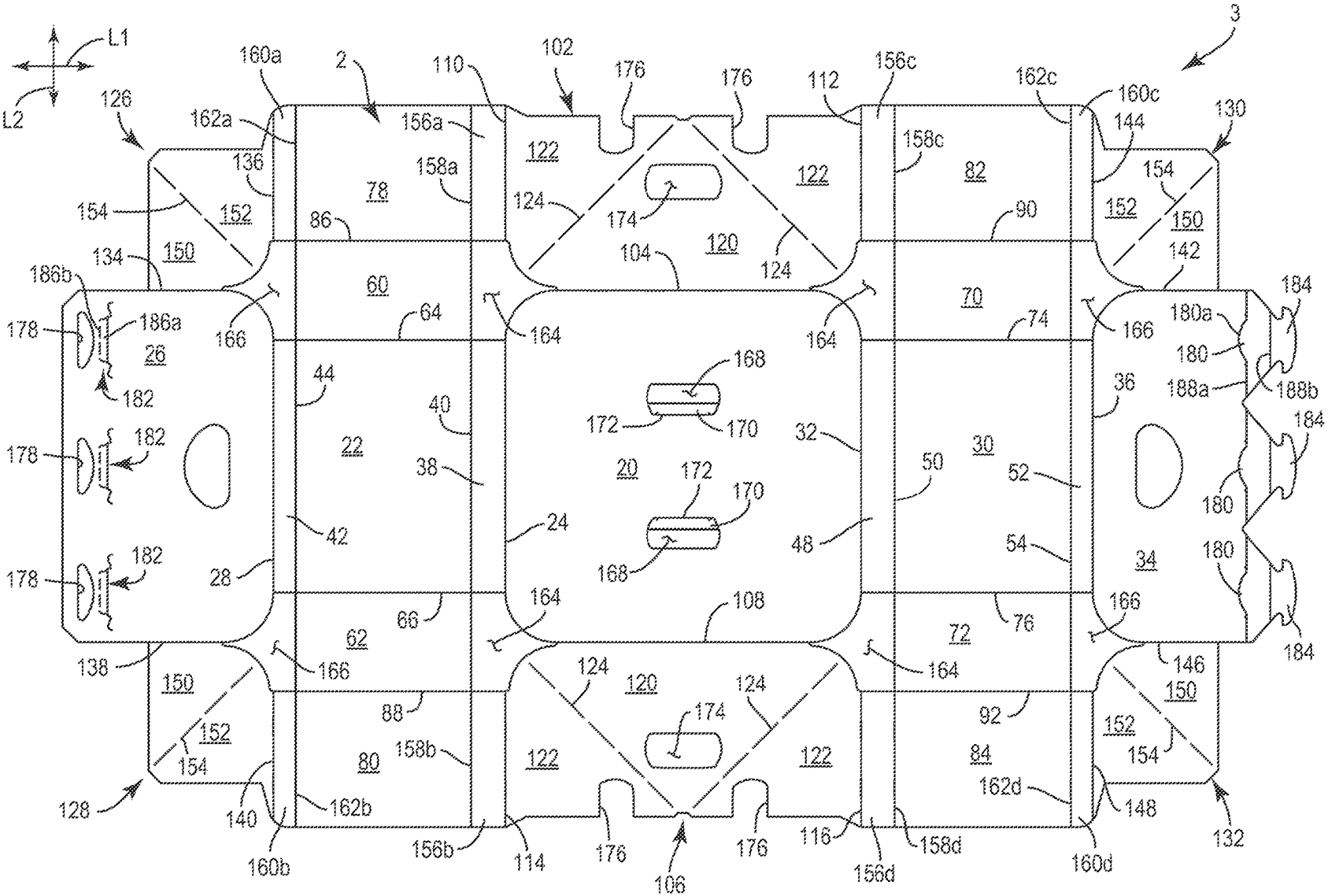
FIG. 1 is a plan view of an interior surface of a blank used to form a carrier according to embodiments of the disclosure.

FIG. 1 is a plan view of an interior surface 2 of a blank 3, used to form a carton or carrier 5 (FIGS. 3 and 4) according to embodiments of the disclosure. In the illustrated embodiments, the carrier 5 can be a fully enclosed carton with at least partially closed ends 6, 8 that wraps around the containers C (e.g., the carrier 5 may be referred to as a wrap-around carton or carrier). The carrier 5 can be used to house a plurality of articles such as containers C (FIGS. 2A-4) to form a package 7 (FIGS. 3 and 4). As shown in FIGS. 2A-4, the containers C are beverage cans. In other exemplary embodiments, the containers could be food cans, bottles for food and/or beverages, jars, and/or other suitable articles. The carrier 5 can be sized to house nine containers in a single layer in a 3×3 arrangement, but it is understood that the carrier 5 may be sized and shaped to hold containers of a different or same quantity in more than one layer and/or in different row/column arrangements (e.g., 1×6, 2×6, 3×2, 3×4, 4×6, 3×8, 2×6×2, 3×4×2, 2×9, 3×6, etc.), or just a single article. In embodiments, the carrier 5 can include corners 11 (e.g., four corners or any suitable number of corners), which can be configured as rounded corners, for example. In other examples, the carrier could have other suitable corners, such as open corners), bevel corners, or any suitable corner configuration. In addition, the carrier 5 can include a handle, generally indicated at 198, for grasping and carrying the carrier.

The blank 3 has a longitudinal axis L1 and a lateral axis L2. In the illustrated embodiments, the blank 3 can include a central or top panel 20 foldably connected to a first side panel 22 at a first lateral fold line 24, a first bottom panel 26 foldably connected to the first side panel 22 at a second lateral fold line 28, a second side panel 30 foldably connected to the top panel 20 at a third lateral fold line 32, and a second bottom panel 34 foldably connected to the second side panel 30 at a fourth lateral fold line 36. In the illustrated embodiments, the first side panel 22 can include a first upper bevel or taper panel 38 at least partially defined between the lateral fold line 24 and a lateral fold line 40 extending in the first side panel 22, and the first side panel 22 can include a first lower bevel or taper panel 42 at least partially defined between the lateral fold line 26 and a lateral fold line 44 extending in the first side panel 22. In embodiments, a central portion of the first side panel 22 can extend between the lateral fold lines 40, 44. As shown in FIG. 1, the second side panel 30 can include a second upper bevel or taper panel 48 at least partially defined between the lateral fold line 32 and a lateral fold line 50 extending in the second side panel 30, and the second side panel 30 can include a second lower bevel or taper panel 52 at least partially defined between the lateral fold line 36 and a lateral fold line 54 extending in the second side panel 30. In embodiments, a central portion of the second side panel 30 can extend between the lateral fold lines 50, 54.

As shown in FIG. 1, the first side panel 22 can be foldably connected to two corner panels 60, 62 (e.g., a first corner panel 60 and a second corner panel 62) along respective longitudinal fold lines 64, 66, and the second side panel 30 can be foldably connected to two corner panels 70, 72 (e.g., a third corner panel 70 and a fourth corner panel 72) along respective longitudinal fold lines 74, 76. In the illustrated embodiments, end panels 78, 80, 82, 84 can be foldably connected to the respective corner panels 60, 62, 70, 72 along respective longitudinal fold lines 86, 88, 90, 92. In embodiments, the end panels 78, 82 can extend along a first marginal portion of the blank 3 for at least partially closing the first end 6 of the carton 5 (FIGS. 3 and 4), and the end panels 80, 84 can extend along a second marginal portion of the blank 3 for at least partially closing the second end 8 of the carton 5 (FIGS. 3 and 4). Any of the top panel 20, the side panels 22, 30, the bottom panels 26, 34, the corner panels 60, 62, 70, 72, and/or the end panels 78, 80, 82, 84 could be omitted or could be otherwise shaped, arranged, positioned, and/or configured without departing from the disclosure.

In the illustrated embodiments, the blank 3 further can include a first top gusset 102 foldably connected to the top panel 20 along a longitudinal fold line 104 and a second top gusset 106 foldably connected to the top panel 20 along a longitudinal fold line 108. As shown in FIG. 1, the first top gusset 102 can be foldably connected to the end panels 78, 82 along respective lateral fold lines 110, 112, and the second top gusset 106 can be foldably connected to the end panels 80, 84 along respective lateral fold lines 114, 116. In the illustrated embodiments, each of the top gussets 102, 106 can include a central gusset panel 120 foldably connected to two top gusset panels 122 along respective oblique fold lines 124. In embodiments, each of the central gusset panels 120 can be at least partially defined by the respective longitudinal fold lines 104, 108 and the respective oblique fold lines 124, and each of the top gusset panels 122 can be at least partially defined by a respective one of the oblique fold lines 124, the respective lateral fold lines 110, 112, 114, 116, and an outer edge of the blank 3.

As shown in FIG. 1, the first bottom panel 26 can be connected to the end panels 78, 80 by respective bottom gussets 126, 128, and the second bottom panel 34 can be connected to the end panels 82, 84 by respective bottom gussets 130, 132. In embodiments, the bottom gusset 126 can be foldably connected to the first bottom panel 26 along a longitudinal fold line 134 and can be foldably connected to the end panel 78 along a lateral fold line 136, and the bottom gusset 128 can be foldably connected to the first bottom panel 26 along a longitudinal fold line 138 and can be foldably connected to the end panel 80 along a lateral fold line 140. Similarly, the bottom gusset 130 can be foldably connected to the second bottom panel 34 along a longitudinal fold line 142 and can be foldably connected to the end panel 82 along a lateral fold line 144, and the bottom gusset 132 can be foldably connected to the second bottom panel 34 along a longitudinal fold line 146 and can be foldably connected to the end panel 84 along a lateral fold line 148. As shown in FIG. 1, each of the bottom gussets 126, 128, 130, 132 can include a first bottom gusset panel 150 foldably connected to a second bottom gusset panel 152 along an oblique fold line 154. In the illustrated embodiments, each of the first bottom gusset panels 150 can be at least partially defined by the respective longitudinal fold lines 134, 138, 142, 147, the respective oblique fold lines 154, and the outer edge of the blank 3, and each of the second bottom gusset panels 152 can be at least partially defined by the respective lateral fold lines 136, 140, 144, 148, the respective oblique fold lines 154, and the outer edge of the blank 3. Any of the top gussets 102, 106 and/or the bottom gussets 126, 128, 130, 132 could be omitted or could be otherwise shaped, arranged, positioned, and/or configured without departing from the disclosure.

In the illustrated embodiments, the end panel 78 can include an upper bevel or taper panel 156*a* at least partially defined between the lateral fold line 110 and a lateral fold line 158*a* extending in the end panel 78, and the end panel 78 can include a lower bevel or taper panel 160*a* at least partially defined between the lateral fold line 136 and a lateral fold line 162*a* extending in the end panel 78. In embodiments, a central portion of the end panel 78 can extend between the lateral fold lines 158*a*, 162*a*. As shown in FIG. 1, the end panel 80 can include an upper bevel or taper panel 156*b* at least partially defined between the lateral fold line 114 and a lateral fold line 158*b* extending in the end panel 80, and the end panel 80 can include a lower bevel or taper panel 160*b* at least partially defined between the lateral fold line 140 and a lateral fold line 162*b* extending in the end panel 80. In embodiments, a central portion of the end panel 80 can extend between the lateral fold lines 158*b*, 162*b*. Similarly, the end panel 82 can include an upper bevel or taper panel 156*c* at least partially defined between the lateral fold line 112 and a lateral fold line 158*c* extending in the end panel 82, and the end panel 82 can include a lower bevel or taper panel 160*c* at least partially defined between the lateral fold line 144 and a lateral fold line 162*c* extending in the end panel 82. In embodiments, a central portion of the end panel 82 can extend between the lateral fold lines 158*c*, 162*c*. As shown in FIG. 1, the end panel 84 can include an upper bevel or taper panel 156*d* at least partially defined between the lateral fold line 116 and a lateral fold line 158*d* extending in the end panel 84, and the end panel 84 can include a lower bevel or taper panel 160*d* at least partially defined between the lateral fold line 148 and a lateral fold line 162*d* extending in the end panel 84. In embodiments, a central portion of the end panel 84 can extend between the lateral fold lines 158*d*, 162*d*. Any of the end panels 78, 80, 82, 84 and/or the taper panels 156*a*, 160*a*, 156*b*, 160*b*, 156*c*, 160*c*, 156*d*, 160*d* could be omitted or could be otherwise shaped, arranged, positioned, and/or configured without departing from the disclosure.

As shown in FIG. 1, the blank 3 can include upper cutouts 164 extending along the respective corner panels 60, 62, 70, 72 and along respective corners of the top panel 20 and can include lower cutouts 166 extending along the respective corner panels 60, 62, 70, 72 and along respective corners of the respective bottom panels 26, 34. For example, the upper cutout 164 associated with the end panel 60 can extend along edges of the top panel 20, the top gusset 102, the upper taper panel 38 of the first side panel 22, the upper taper panel 156*a* of the end panel 78, and the corner panel 60, and the lower cutout 166 associated with the end panel 60 can extend along edges of the first bottom panel 26, the bottom gusset 126, the lower taper panel 42 of the first side panel 22, the lower taper panel 160*a* of the end panel 78, and the corner panel 60. The other cutouts 164, 166 similarly extend along edges of the respectively adjacent panels of the blank 3. Any of the cutouts 164, 166 could be omitted or could be otherwise shaped, arranged, positioned, and/or configured without departing from the disclosure.

In the illustrated embodiments, the blank 3 can include handle features extending in the top panel 20 and the top gussets 102, 106, for example. As shown in FIG. 1, the handle features can include two spaced finger holes 168, each with a respective comfort flap 170 foldably connected to the top panel 20 along a respective fold line 172. In embodiments, the handle features further can include a clearance opening 174 in each of the central gusset panels 120 and a recess or cutout 176 in each of the top gusset panels 122. For example, each of the recesses 176 can extend from the outer edge of the blank 3. In the illustrated embodiments, the clearance openings 174 and the recesses 176 are positioned in the respective top gussets 102, 106 so that the clearance openings 174 and the recesses 176 are aligned with the respective finger holes 168 in the top panel 20 when the top gussets 102, 106 are folded under the top panel 20 during the formation of the carton 5, as described in more detail below (e.g., so that a user can insert one or more fingers into the interior of the carton 5 through the finger holes 168, the clearance openings 174, and the recesses 176 to grasp the carton 5 at the handle). Any of the handle features could be omitted or could be otherwise shaped, arranged, positioned, and/or configured without departing from the disclosure.

The first bottom panel 26, which can be referred to as the inner bottom panel in the assembled carton 5, includes cutouts forming primary locking edges 178 that are shaped and positioned to engage primary locking tab projections 180 on the second bottom panel 34, which can be referred to as the outer bottom panel in the completed carrier 5. The first bottom panel 26 also includes slits 182 shaped and positioned to receive outer secondary locking tab projections 184 of the second bottom panel 34. As shown in FIG. 1, the slits 182 can define tabs 186*a* that are foldably connected to the first bottom panel 26 along respective lateral fold lines 186*b*. In embodiments, the tabs 186*a* can fold inwardly along the respective lateral fold lines 186*b* when the secondary locking tab projections 184 engage the respective slits 182 (FIG. 3). In the illustrated embodiments, each of the secondary locking tab projections 184 can be foldably connected to a remainder of the second bottom panel 34 along a respective lateral fold line 188*a*, which can be interrupted by the respective slits or cuts 180*a* (e.g., arcuate cuts) that define the respective primary locking tab projections 180. In addition, each of the secondary locking tab projections 184 can include a lateral fold line 188*b*. Although the locking elements of the blank 3 are illustrated to demonstrate a particular bottom panel locking arrangement suitable for use with the carrier 5, it is understood that any alternative form of bottom panel locking structure may be employed without departing from the disclosure. Additionally, or alternatively, the bottom panels 26, 34 could be glued together.

Figure 2A:
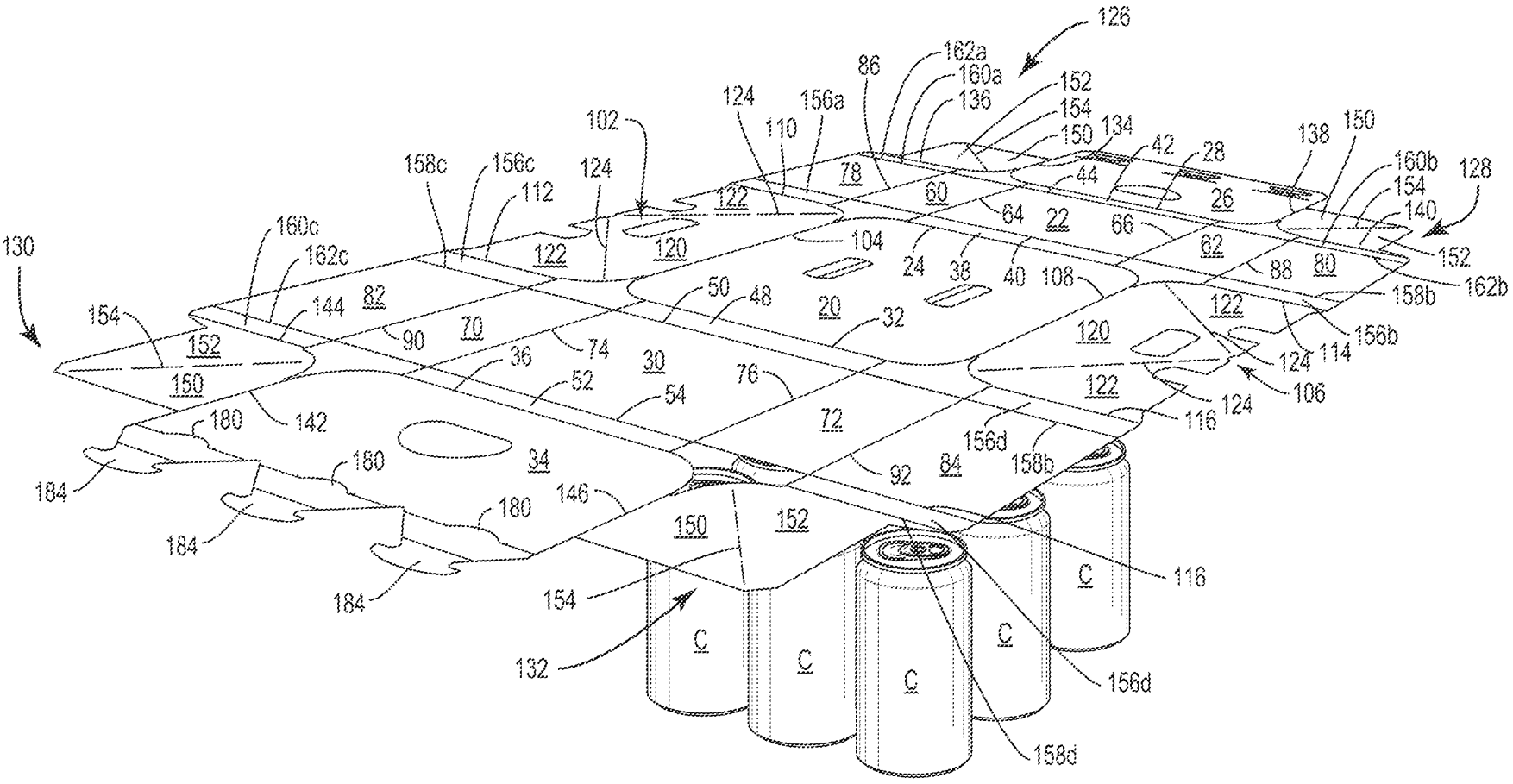
FIGS. 2A-2C are perspective views showing the formation of a package by wrapping the blank of FIG. 1 around an arrangement of containers according to embodiments of the disclosure.
Figure 2B:
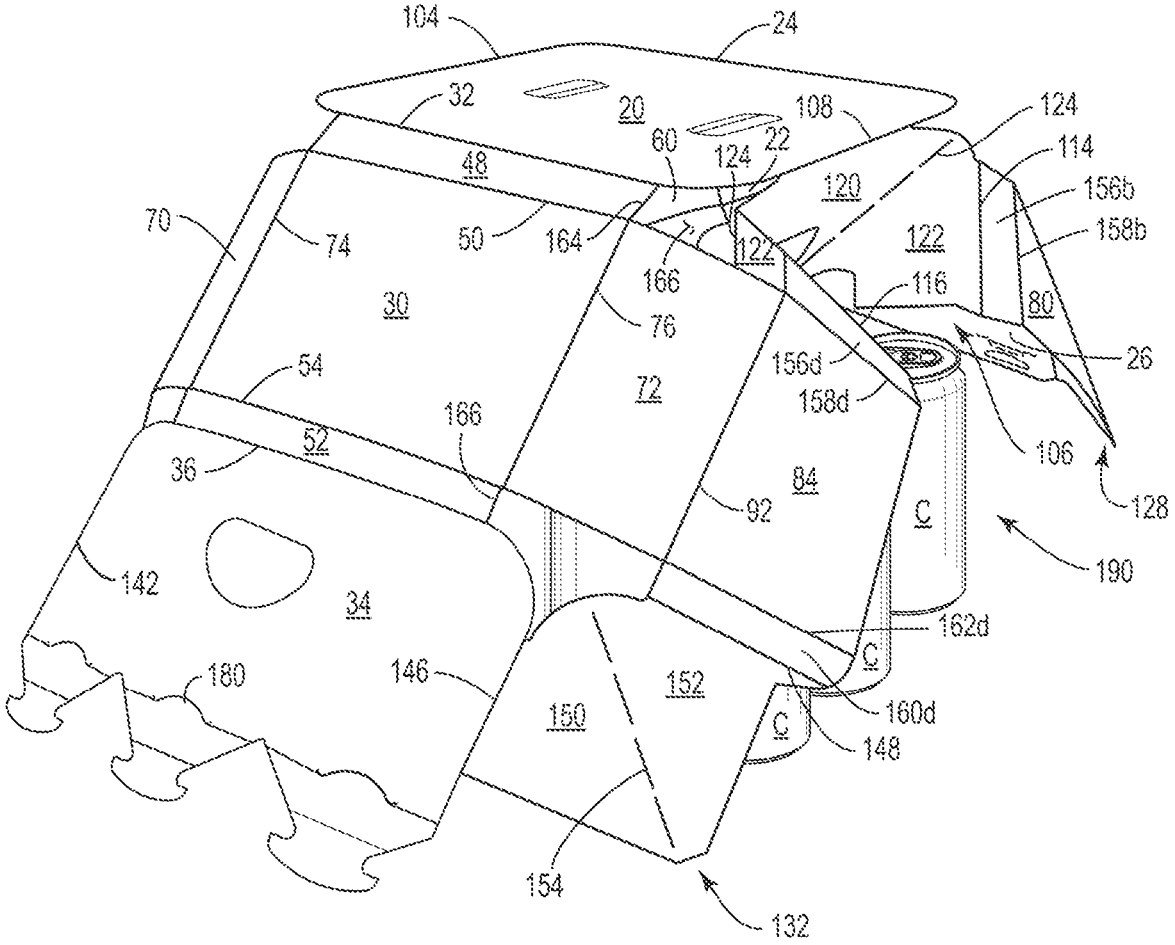
Figure 2C:
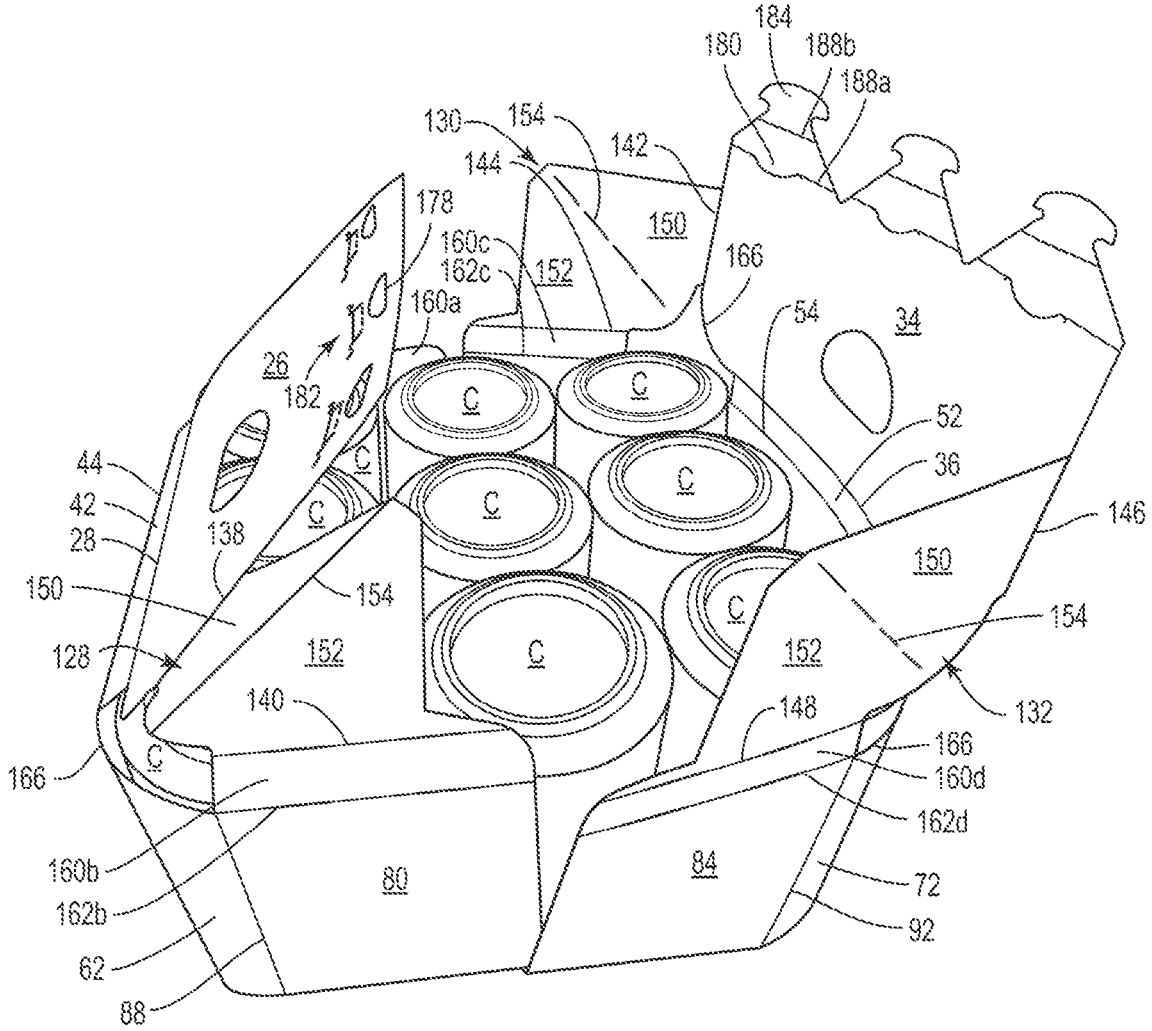
Figure 3:
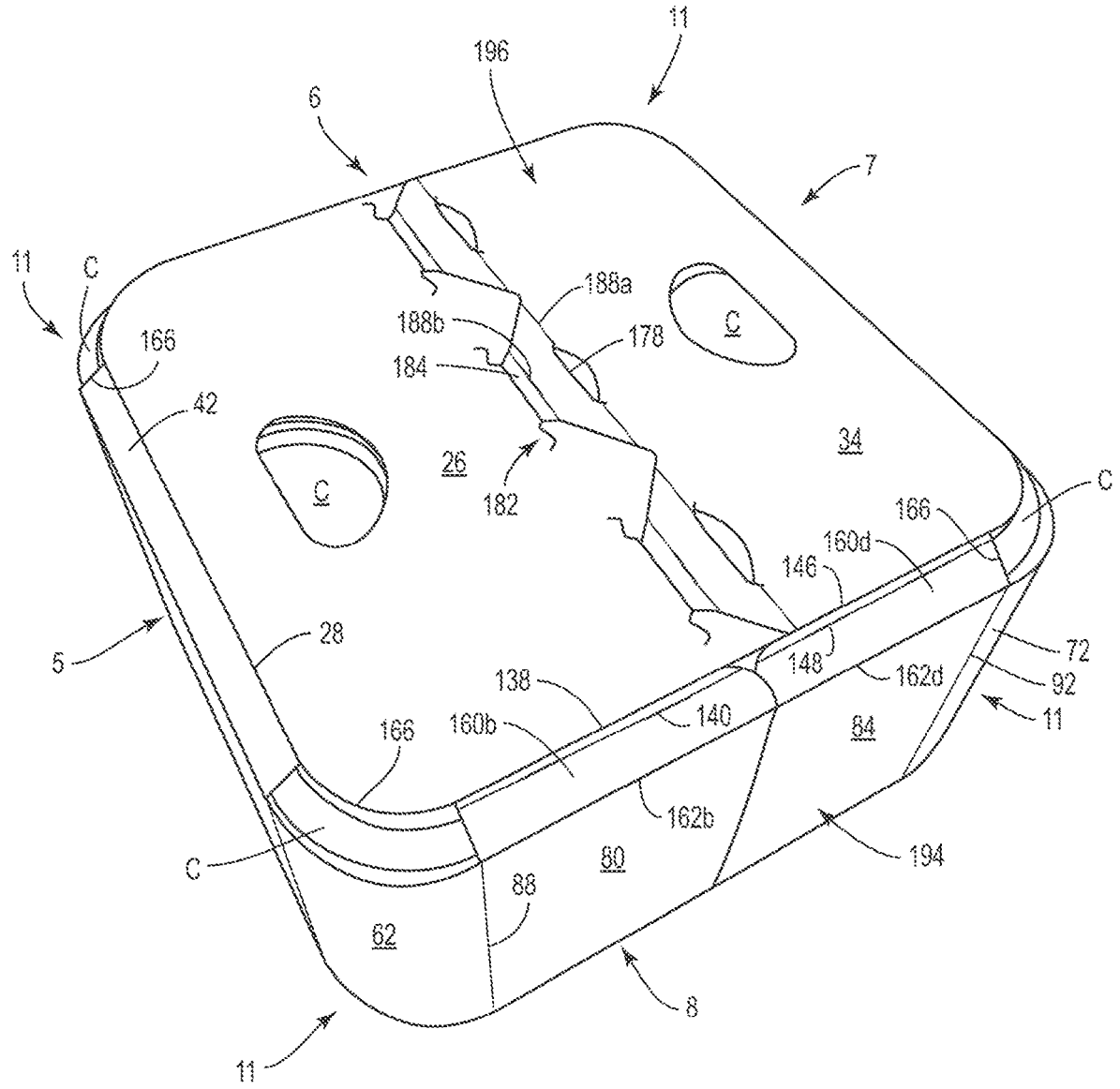
FIGS. 3 and 4 are perspective views of the package including the carrier formed from the blank of FIG. 1 and the containers according to embodiments of the disclosure.
Figure 4:
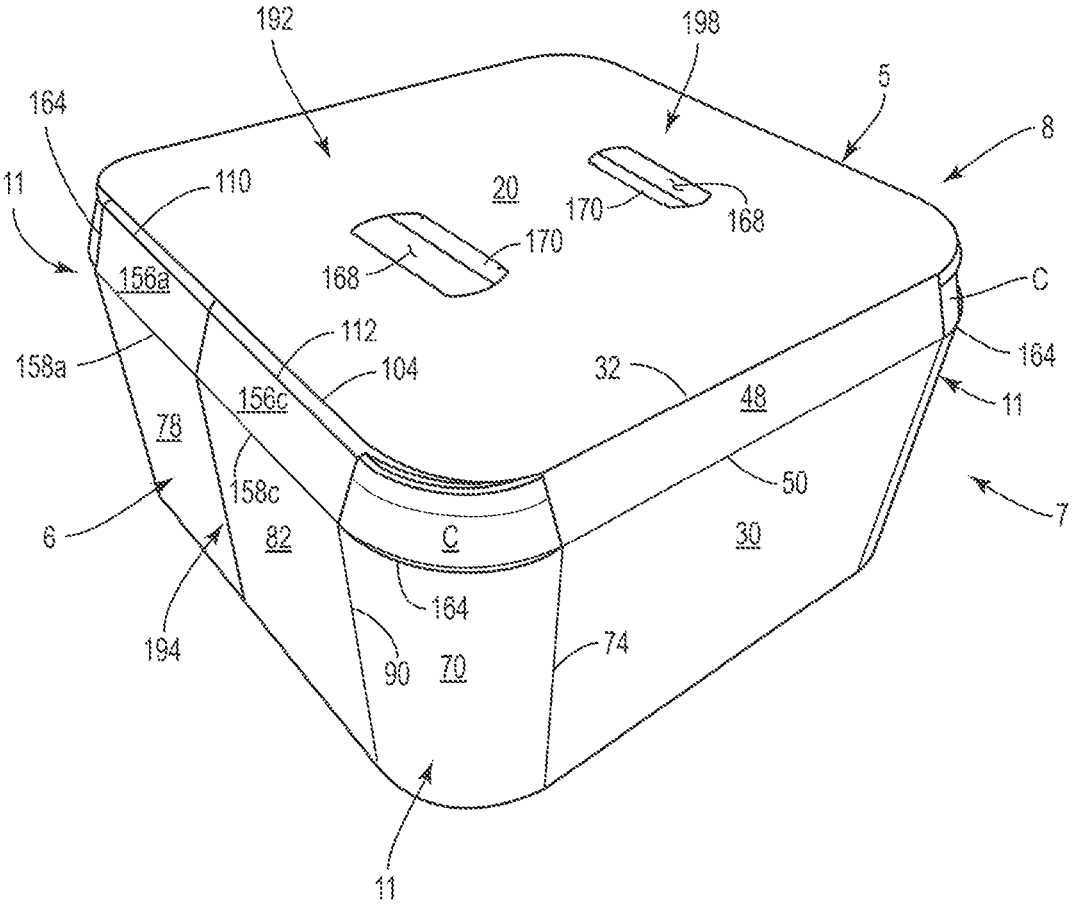

As shown in FIGS. 2A-3, the package 7 can be formed by wrapping the blank 3 around the plurality of containers C to form the carrier 5. For example, as shown in FIG. 2A, the blank 3 can be fed along a path of travel so that the top panel 20 is generally aligned over an arrangement or grouping of the containers C (e.g., a 3×3 arrangement or any other suitable arrangement). As shown in FIG. 2B, the top gussets 102, 106 can be folded under the top panel 20, the side panels 22, 30 can be folded downwardly over the sides of the arrangement of containers C, and the end panels 60, 62, 70, 72 can be folded inwardly over the respective ends 6, 8 while moving the blank 3 downwardly toward the arrangement of containers C so that the carrier 5 is formed around the containers C. As the top gussets 102, 106 are backfolded, the central gusset panels 120 can fold along the respective longitudinal fold lines 104, 108 into overlapping relationship with the top panel 20 (e.g., the interior sides of the gusset panels can be in face-to-face contact with the interior side of the top panel 20). Further, as the top gussets 106, 108 are backfolded, the top gusset panels 122 are folded along the respective oblique fold lines 124 into an overlapping relationship with the respective central gusset panels 120 (e.g., the exterior sides of the top gusset panels 122 are in face-to-face contact with the exterior sides of the respective central gusset panels 120). In the illustrated embodiments, as the top gussets 102, 106 are backfolded, the top gusset panels 122 can fold along the respective lateral fold lines 110, 112, 114, 116 and can pull the respective end panels 78, 82, 80, 84 over the respective ends of the carrier 5. In turn, the end panels 78, 80 and 82, 84 can pull the respective side panels 22, 30 downwardly at the sides of the carrier 5, and the corner panels 60, 62, 70, 72 can curve along respective corners of the carrier 5 (e.g., along the curved sides of the containers C at the respective corners) so that the top panel 20, the side panels 22, 30, the corner panels 60, 62, 70, 72, and the end panels 78, 80, 82, 84 extend around an interior 190 of the carrier 5 (FIG. 2C). In embodiments, the top panel 20 and the top gussets 102, 106 can cooperate to form a top wall 192 (FIG. 4), the end panels 78, 82 can be at least partially overlapped to form an end wall 194 at the first closed end 6 of the carrier 5 (FIG. 4), and the end panels 70, 84 can be at least partially overlapped to form an end wall 194 at the second closed end 8 of the carrier 5 (FIG. 3).

As shown in FIG. 2C, the carrier 5 further can be formed by folding the bottom gussets 126, 128 inwardly and folding the first bottom panel 26 to extend along the bottom of the carrier 5 so that the bottom gussets 126, 128 are positioned between the bottoms of the containers C and the first bottom panel 26. In embodiments, the bottom gusset panels 150, 152 of the respective bottom gussets 126, 128 are folded along the respective oblique fold lines 154, the respective longitudinal fold lines 134, 138 and the respective lateral fold line 136, 140 so that the first gusset panels 150 are in an overlapping relationship with the first bottom panel 26 and the second gusset panels 152 are in an overlapping relationship with the respective first gusset panels 150 (e.g., the interior sides of the first gusset panels 150 can be in face-to-face contact with the interior side of the first bottom panel 26 and the exterior sides of the second gusset panels 152 can be in face-to-face contact with the exterior sides of the respective first gusset panels 150). In the illustrated embodiments, the bottom gussets 126, 128 and the first bottom panel 26 can be folded to position the bottom gussets 126, 128 between the first bottom panel 26 and the bottoms of one or more respective containers C of the plurality of containers C. For example, the bottom gussets 126, 128 can be in contact with the bottoms of at least the containers C at the respective corners of the package 7.

In the illustrated embodiments, the second bottom panel 34 and the bottom gussets 130, 132 can be folded similarly or identically to the first bottom panel 26 and the bottom gussets 126, 128 so that the second bottom panel 34 extends along the bottom of the carrier 5 and so that so that the bottom gussets 130, 132 are positioned between the bottoms of the containers C and the second bottom panel 34. As shown in FIG. 3, the second bottom panel 34 can be in an at least partially overlapping relationship with the first bottom panel 26.

As shown in FIG. 3, the locking elements of the first bottom panel 26 and the second bottom panel 34 can be interlocked/intermeshed to secure the bottom panels 26, 34 together and form a bottom wall 196 (e.g., including the bottom panels 26, 34 and the bottom gussets 126, 128, 130, 132).

For example, second bottom panel 34 can be folded along the lateral fold lines 188*a* so that the primary locking tab projections 180 separate from the remainder of the second bottom panel 34 along the respective cuts 180*a* and so that the primary locking tab projections 180 extend toward the first bottom panel 26. In embodiments, the primary locking tab projections 180 can be positioned to engage (e.g., contact) the respective primary locking edges 178 in the first bottom panel 26 so that the primary locking tab projections 180 are at least partially received in the cutouts forming the primary locking edges 178. Subsequently, the secondary locking tab projections 184 can be folded along the respective fold lines 188*b* toward the first bottom panel 26 and the second bottom panel 34 can be folded along the fold lines 188*a* to move the secondary locking tab projections 184 toward the respective slits 182 in the first bottom panel 26. In the illustrated embodiments, the secondary locking tab projections 184 can be inserted into the respective slits 182 so that the secondary locking tab projections are at least partially received in the respective slits 182. In embodiments, when the locking tab projections 180, 184 are at least partially received in the respective cutouts and slits, the locking tab projections can extend along an interior of the first bottom panel 26. The interlocked locking elements can secure the bottom panels 26, 34 together and can at least partially hold the carrier securely around the containers C to help maintain the formed package 7 (e.g., without the use of adhesive to secure the package).

As shown in FIGS. 3 and 4, the package 7 includes the carrier 5 formed around the containers C. In the illustrated embodiments, the end panels 78, 82 can at least partially form the first closed end 6 of the carrier 5 and the end panels 80, 84 can at least partially form the second closed end 8 of the carrier 5. In embodiments, the corner panels 60, 62, 70, 72 can form the respective rounded or curved corners 11 of the carrier 5 with at least the respective containers C at the respective corners 11 of the package 7 being partially visible through the respective upper cutouts 164 and the respective lower cutouts 166. For example, the rounded or curved corners 11 can include the respective corner panels 60, 62, 70, 72 extending along portions of the external surfaces of the respective containers C at the respective corners 11 (e.g., the corner panels 60, 62, 70, 72 can be curved along the surfaces of the corner containers C). As shown in FIGS. 3 and 4, containers C can be tapered at the top and bottom (e.g., for beverage cans), and the carrier 5 can be tapered inwardly at the top wall 192 by the upper taper panels 38, 48, 156*a*, 156*b*, 156*c*, 156*d* and at the bottom wall 196 by the lower taper panels 42, 52, 160*a*, 160*b*, 160*c*, 160*d*.

As shown in FIG. 4, the carrier 5 can include a handle 198 in at least the top wall 192. In the illustrated embodiments, the clearance opening 174 and the recesses 176 of the top gussets 102, 106 can be at least partially aligned with the respective finger holes 168 in the top panel 20 when the top gussets 102, 106 are backfolded to form the top wall 192 as described above.

Accordingly, the handle 198 can include the finger holes 168 and the clearance holes 174 and the recesses 176 of the respective top gussets 102, 106. In embodiments, the package can be grasped and/or carried, such as by inserting one or more fingers of one or both hands into the respective finger holes 168 and grasping the top panel 20 and the top gussets 102, 106 adjacent the finger holes 168 (e.g., grasping the portions of the top wall 192 between the finger holes 168). The carrier 5 could be otherwise shaped, arranged, positioned, and/or configured without departing from the disclosure. For example, one or more of the taper panels could be omitted (e.g., so that the sides and/or end walls of the carrier extend vertically from the top wall and/or from the bottom wall). In another example, the corner panels, the upper cutouts, and/or the lower cutouts could have different shapes and/or sizes (e.g., one or more of the cutouts could be minimized or eliminated, one or more of the corner panels could be omitted, etc.). In a further example, the handle 198 could be otherwise configured or could be omitted (e.g., handle features could be formed in the side panels 22, 30 and/or the end walls 194).

As shown in FIGS. 3 and 4, the primary and secondary locking features can be interlocked and can cooperate to lock the carrier 5 in position around the containers C to form the package 7. In embodiments, the carrier 5 can be erected without glue or adhesive, and the locking features can retain the carrier 5 in a tight and secure fit around the containers C. In other embodiments, one or more features of the carrier can be attached by glue or adhesive or other suitable methods. The package could be otherwise formed without departing from the disclosure. For example, the blank 3 can be wrapped downwardly over the containers C from above, the blank 3 can be wrapped upwardly around the containers C from below, etc.

Figure 5:
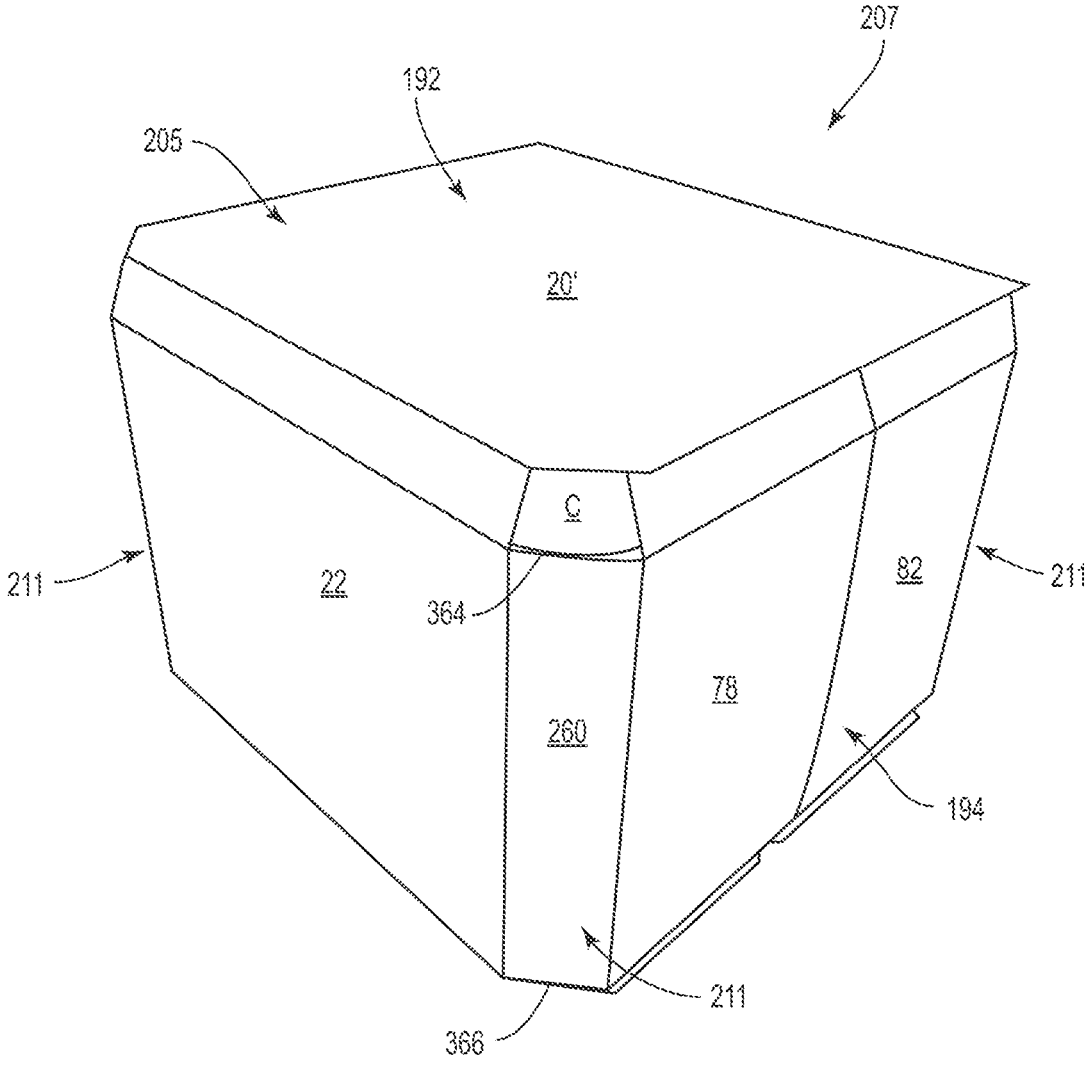
FIGS. 5-8 are perspective views of packages according to additional embodiments of the disclosure.

FIG. 5 illustrates a package 207 including a carrier 205 configured for holding the containers C or other suitable containers according to additional embodiments of the disclosure. The second embodiment is generally similar to the prior embodiments, except for variations noted and variations that will be apparent to one of ordinary skill in the art. Accordingly, like or similar features are indicated with like or similar reference numbers between the two embodiments. As shown in FIG. 5, the corners 211 of the carrier 205 can include corner panels (e.g., wherein the corner panel 260 is shown in the figure) that are bevel corner panels that extend obliquely between the respective side panels 22, 30 and the respective end walls 194. In the illustrated embodiments, the corners 211 can include upper and lower cutouts 364, 366 extending along the respective corner panels. In embodiments, the beveled panels (e.g., corner panel 260 and the other corner panels) can be flat/planar (e.g., substantially, generally, approximately flat/planar) panels and/or can contact at least a portion of a container C at the respective corner 211 of the package 207. As shown in FIG. 5, the handle can be omitted in top panel 20' of the carrier 205. The carrier 205 and/or the package 207 could be otherwise shaped, arranged, positioned, and/or configured without departing from the disclosure.

Figure 6:
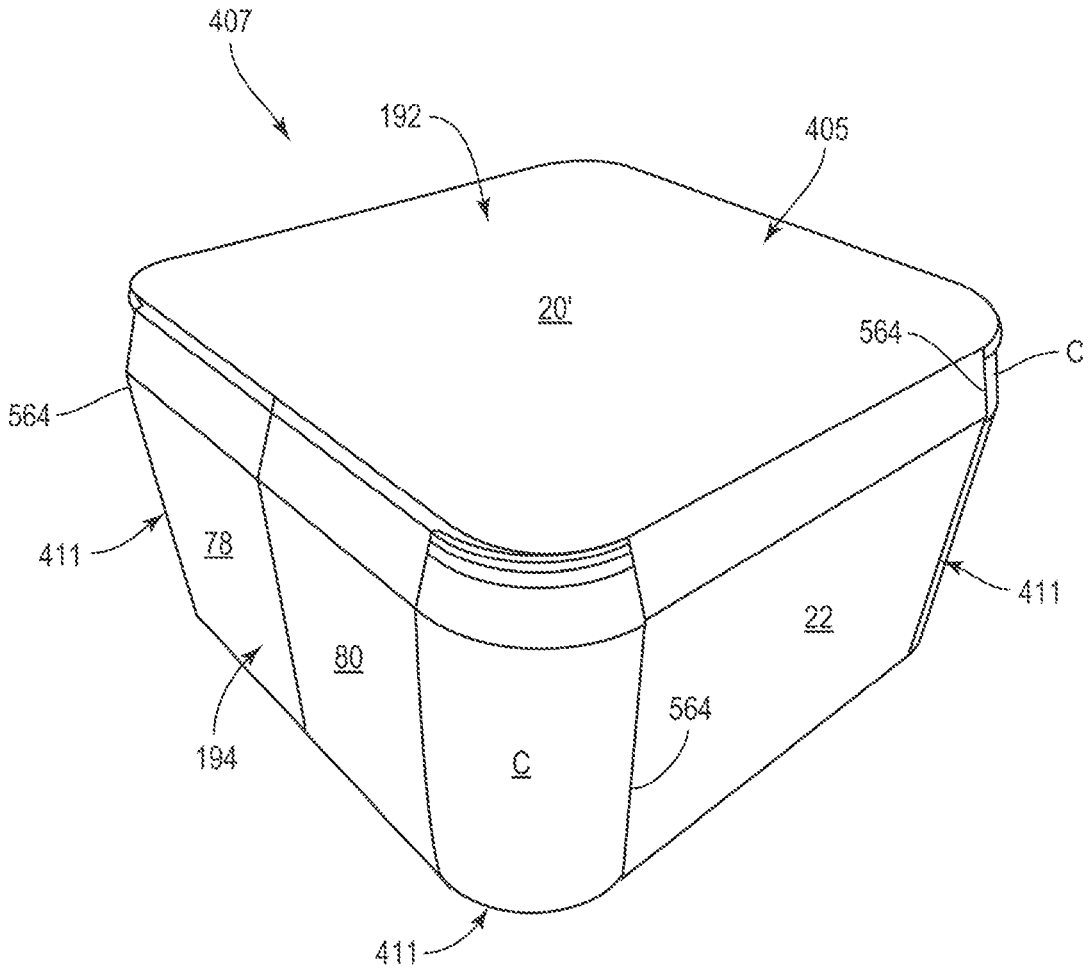

FIG. 6 illustrates a package 407 including a carrier 405 configured for holding the containers C or other suitable containers according to additional embodiments of the disclosure. The third embodiment is generally similar to the prior embodiments, except for variations noted and variations that will be apparent to one of ordinary skill in the art. Accordingly, like or similar features are indicated with like or similar reference numbers between the two embodiments. As shown in FIG. 6, the corners 411 of the carrier 405 can be open corners 411, wherein the corner panels are omitted. In the illustrated embodiments, the containers C at the corners can extend along the respective corner windows or openings 564 at the corners 411 so that the respective containers C are visible along the open corners 411. In embodiments, the corner windows 564 along the corners 411 can be narrower than the corner containers C so that the side panels 22, 30 and the end walls 194 can retain the corner containers C and the other containers C in the interior of the carrier 405. The carrier 405 and/or the package 407 could be otherwise shaped, arranged, positioned, and/or configured without departing from the disclosure.

Figure 7:
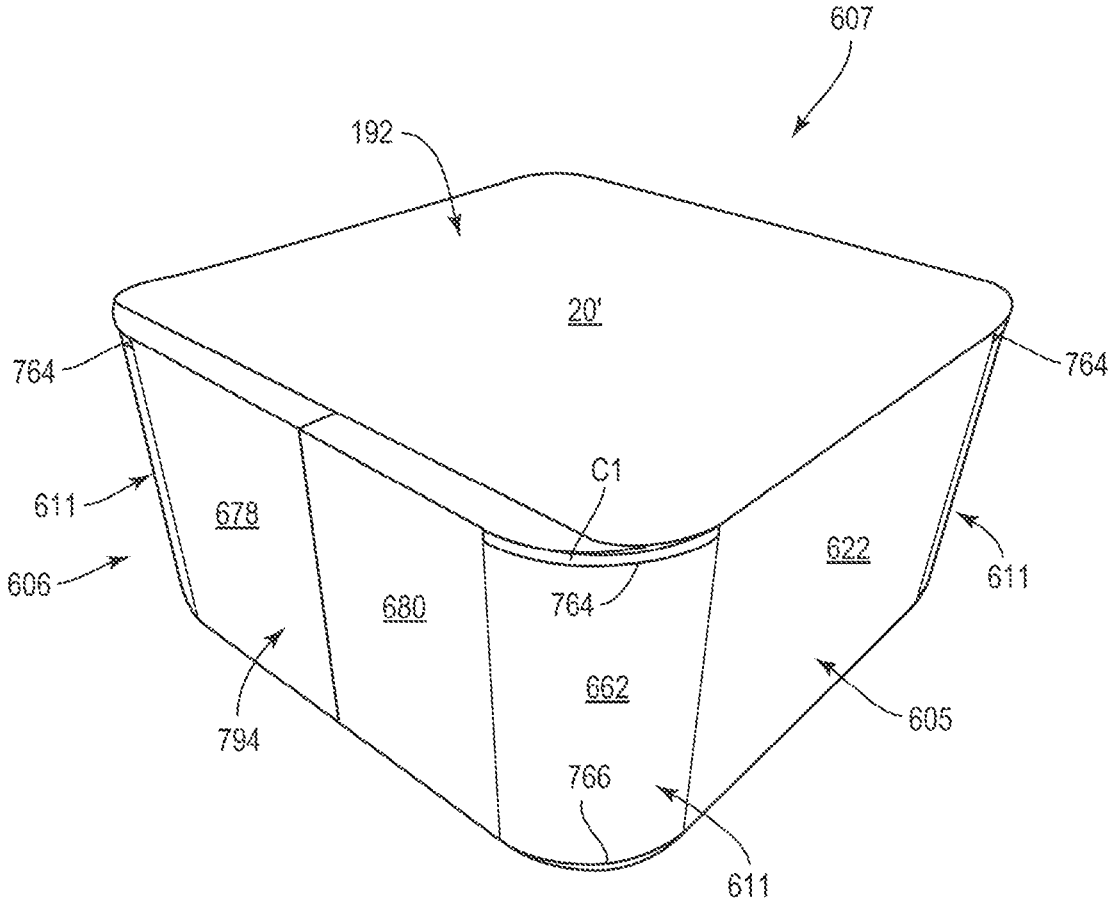

FIG. 7 illustrates a package 607 including a carrier 605 configured for holding articles, such as food cans C1 (e.g., soup cans or other suitable articles) according to additional embodiments of the disclosure. The second embodiment is generally similar to the prior embodiments, except for variations noted and variations that will be apparent to one of ordinary skill in the art. Accordingly, like or similar features are indicated with like or similar reference numbers between the two embodiments. As shown in FIG. 7, the corners 611 of the carrier 605 can include corner panels (e.g., the corner panel 662 is shown in FIG. 7) that extend along the cylindrical sides of the corner containers C1 to the chimes at the top and bottom of the corner containers. In the illustrated embodiments, the chimes of the corner containers can be at least partially received in respective upper and lower cutouts 764, 766 of the carrier 605 extending along the respective corner panels 662. As shown in FIG. 7, the taper panels can be omitted in the carrier 605 so that the side panels (the side panel 622 is shown in FIG. 7) and the end walls, including the end panels (the end panels 678, 680 of the first end 606 are shown in FIG. 7), extend vertically (e.g., approximately, generally, and/or substantially vertically) between the top wall 192 and the bottom wall 196 of the carrier 605. The carrier 605 and/or the package 607 could be otherwise shaped, arranged, positioned, and/or configured without departing from the disclosure.

Figure 8:
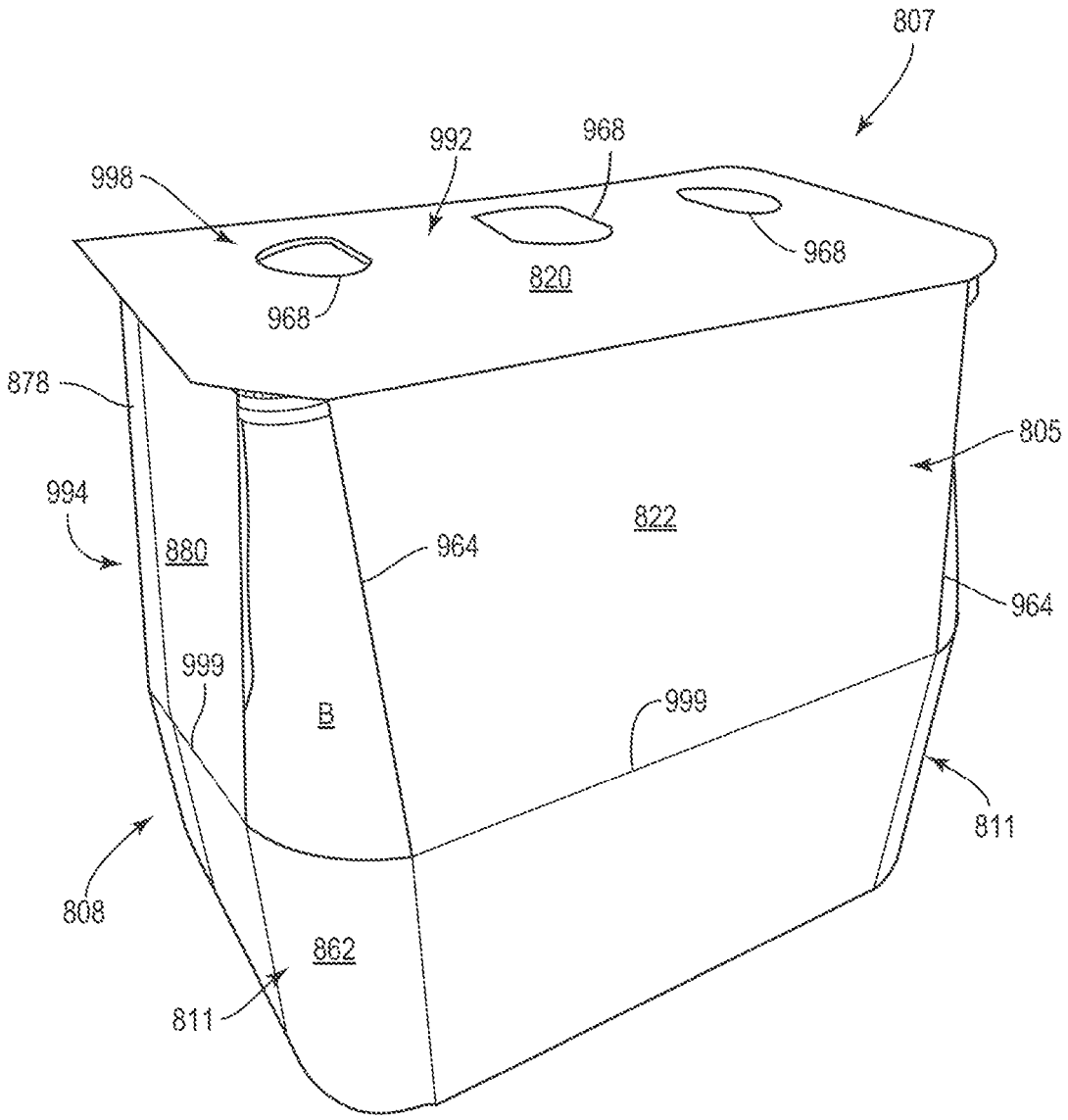

FIG. 8 illustrates a package 807 including a carrier 805 configured for holding articles, such as glass beverage bottles B according to additional embodiments of the disclosure. The second embodiment is generally similar to the prior embodiments, except for variations noted and variations that will be apparent to one of ordinary skill in the art. Accordingly, like or similar features are indicated with like or similar reference numbers between the two embodiments. As shown in FIG. 8, the carrier 805 can include corners 811 with curved corner panels (corner panel 862 is shown in FIG. 8) extending along the curved sides of the bottles B at the corners 811 of the package 807. In embodiments, the upper cutouts 964 can extend along the upper portions or necks of the bottles B, for example. In the illustrated embodiments, a handle 998 with three finger openings 968 can extend in the top wall 992 (e.g., in at least the top panel 820). As shown in FIG. 8, the side panels (e.g., the side panel 822 is shown in FIG. 8) and the end panels (e.g., the end panels 880, 884 are shown in FIG. 8) can be tapered along at least the neck portions of the respectively adjacent bottles B. In embodiments, the side panels and the end panels can include an intermediate fold line 999, and the upper portions of the side panels and the end panels can be tapered from the intermediate fold line 999. The carrier 805 and/or the package 807 could be otherwise shaped, arranged, positioned, and/or configured without departing from the disclosure.

In embodiments, the top and bottom gussets can cooperate with the upper and lower taper panels to secure a tight fitment around the containers. In some embodiments, the rounded, bevel, or open corners of the carriers can provide a premium look to the corners 11 of the package 7. In exemplary embodiments, the fully enclosed carrier can have zero adhesive application in the manufacturing and/or packaging processes. In embodiments, the blank 3 and carrier 5 can be configured to enclose a large range of arrangements of containers C (e.g., 2×2 to 2×6, 3×3 to 3×6, 4×4 to 4×6, etc.). In embodiments, rounded corner, beveled corner, and open corner configurations can help reduce or eliminate damage to the corners of the packages on packaging conveyor lines and/or during transportation as compared to carriers with corners that extend outwardly from the corner containers C, for example. In embodiments, the corners can be formed from a unique gusseted folding sequence, wherein the top and/or bottom gusset has a series of cuts and creases that wraps the containers keeping them tight and secure within the carton.

Any of the features of the various embodiments of the disclosure can be combined with, replaced by, or otherwise configured with other features of other embodiments of the disclosure without departing from the scope of this disclosure.

In general, the blanks according to the present disclosure can be constructed from paperboard having a caliper so that it is heavier and more rigid than ordinary paper. The blanks can also be constructed of other materials, such as cardboard, or any other material having properties suitable for enabling the carton to function at least generally as described above. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package comprising a carrier holding a plurality of articles, the carrier comprising:

a plurality of panels extending at least partially around an interior of the carrier, the plurality of panels comprising at least a top panel, a first bottom panel, a second bottom panel, and an end panel, the end panel at least partially forming a closed end of the carrier;

a top gusset foldably connected to each of the top panel and the end panel; and a bottom gusset foldably connected to each of the first bottom panel and the end panel;

wherein the first bottom panel and the second bottom panel are secured together so that the first bottom panel and the second bottom panel at least partially form a bottom wall opposite to the top panel, the plurality of panels further comprises a side panel foldably connected to each of the top panel and the first bottom panel and a corner panel foldably connected to each of the end panel and the side panel, the corner panel is curved and extends along at least a portion of an article of the plurality of articles at a corner of the package.

2. The package of claim 1, wherein the first bottom panel and the second bottom panel comprise locking elements for securing the first bottom panel and the second bottom panel together.

3. The package of claim 1, wherein the first bottom panel comprises a locking edge or slit, and the second bottom panel comprises a locking tab projection, and wherein the locking edge or slit at least partially receives the locking tab projection to secure the first bottom panel and the second bottom panel together.

4. The package of claim 1, wherein the first bottom panel comprises a locking edge and a slit aligned along a longitudinal direction, and the second bottom panel comprises a primary locking tab projection and a secondary locking tab projection extending away from one another, and wherein the locking edge at least partially receives the primary locking tab projection and the slit at least partially receives the secondary locking tab projection to secure the first bottom panel and the second bottom panel together.

5. The package of claim 1, wherein the top gusset comprises a central gusset panel foldably connected to a top gusset panel along an oblique fold line, the central gusset panel is foldably connected to the top panel along a longitudinal fold line, and the top gusset panel is foldably connected to the side panel along a lateral fold line.

6. The package of claim 1, wherein the bottom gusset comprises a first bottom gusset panel foldably connected to a second bottom gusset panel along an oblique fold line, the first bottom gusset panel is foldably connected to the first bottom panel along a longitudinal fold line, and the second bottom gusset panel is foldably connected to the end panel along a lateral fold line.

7. The package of claim 1, wherein the top gusset is foldably connected to the top panel along a first longitudinal fold line and to the end panel along a first lateral fold line, and the bottom gusset is foldably connected to the first bottom panel along a second longitudinal fold line and to the end panel along a second lateral fold line.

8. The package of claim 1, wherein the end panel is a first end panel, and the carrier further comprises a second end panel foldably connected to the top gusset, and wherein the first end panel and the second end panel cooperate to at least partially form the closed end of the carrier.

9. The package of claim 8, wherein the bottom gusset is a first bottom gusset, and the carrier further comprises a second bottom gusset foldably connected to each of the second bottom panel and the second end panel.

10. The package of claim 9, wherein the closed end is a first closed end of the carrier, and wherein the carrier further comprises a third end panel and a fourth end panel cooperating to at least partially form a second closed end of the carrier, a third bottom gusset foldably connected to each of the first bottom panel and the third end panel, and a fourth bottom gusset foldably connected to each of the second bottom panel and the fourth end panel.

11. The package of claim 10, wherein the top gusset is a first top gusset, and wherein the carrier further comprises a second top gusset foldably connected to each of the top panel, the third end panel, and the fourth end panel.

12. The package of claim 1, wherein the carrier further comprises at least one of an upper cutout extending along at least a portion of the top panel and the end panel and a lower cutout extending along at least a portion of the first bottom panel and the end panel.

13. The package of claim 1, wherein the carrier further comprises a handle comprising a finger hole extending in the top panel and one or more cutouts in the top gusset aligned with the finger hole.

14. The package of claim 1, wherein the top gusset is positioned between the top panel and one or more articles of the plurality of articles.

15. The package of claim 1, wherein the bottom gusset is positioned between the first bottom panel and one or more articles of the plurality of articles.

16. A carrier for holding a plurality of articles, the carrier comprising:

a plurality of panels extending at least partially around an interior of the carrier, the plurality of panels comprising at least a top panel, a first bottom panel, a second bottom panel, and an end panel, the end panel at least partially forming a closed end of the carrier;

a top gusset foldably connected to each of the top panel and the end panel; and a bottom gusset foldably connected to each of the first bottom panel and the end panel;

wherein the first bottom panel and the second bottom panel are secured together so that the first bottom panel and the second bottom panel at least partially form a bottom wall opposite to the top panel, the plurality of panels further comprises a side panel foldably connected to each of the top panel and the first bottom panel and a corner panel foldably connected to each of the end panel and the side panel, the corner panel is curved for extending along at least a portion of an article of the plurality of articles at a corner of the carrier.

17. The carrier of claim 16, wherein the first bottom panel and the second bottom panel comprise locking elements for securing the first bottom panel and the second bottom panel together.

18. The carrier of claim 16, wherein the first bottom panel comprises a locking edge or slit, and the second bottom panel comprises a locking tab projection, and wherein the locking edge or slit at least partially receives the locking tab projection to secure the first bottom panel and the second bottom panel together.

19. The carrier of claim 16, wherein the first bottom panel comprises a locking edge and a slit aligned along a longitudinal direction, and the second bottom panel comprises a primary locking tab projection and a secondary locking tab projection extending away from one another, and wherein the locking edge at least partially receives the primary locking tab projection and the slit at least partially receives the secondary locking tab projection to secure the first bottom panel and the second bottom panel together.

20. The carrier of claim 16, wherein the top gusset comprises a central gusset panel foldably connected to a top gusset panel along an oblique fold line, the central gusset panel is foldably connected to the top panel along a longitudinal fold line, and the top gusset panel is foldably connected to the side panel along a lateral fold line.

21. The carrier of claim 16, wherein the bottom gusset comprises a first bottom gusset panel foldably connected to a second bottom gusset panel along an oblique fold line, the first bottom gusset panel is foldably connected to the first bottom panel along a longitudinal fold line, and the second bottom gusset panel is foldably connected to the end panel along a lateral fold line.

22. The carrier of claim 16, wherein the top gusset is foldably connected to the top panel along a first longitudinal fold line and to the end panel along a first lateral fold line, and the bottom gusset is foldably connected to the first bottom panel along a second longitudinal fold line and to the end panel along a second lateral fold line.

23. The carrier of claim 16, wherein the end panel is a first end panel, and the carrier further comprises a second end panel foldably connected to the top gusset, and wherein the first end panel and the second end panel cooperate to at least partially form the closed end of the carrier.

24. The carrier of claim 23, wherein the bottom gusset is a first bottom gusset, and the carrier further comprises a second bottom gusset foldably connected to each of the second bottom panel and the second end panel.

25. The carrier of claim 24, wherein the closed end is a first closed end of the carrier, and wherein the carrier further comprises a third end panel and a fourth end panel cooperating to at least partially form a second closed end of the carrier, a third bottom gusset foldably connected to each of the first bottom panel and the third end panel, and a fourth bottom gusset foldably connected to each of the second bottom panel and the fourth end panel.

26. The carrier of claim 25, wherein the top gusset is a first top gusset, and wherein the carrier further comprises a second top gusset foldably connected to each of the top panel, the third end panel, and the fourth end panel.

27. The carrier of claim 16, wherein the carrier further comprises at least one of an upper cutout extending along at least a portion of the top panel and the end panel and a lower cutout extending along at least a portion of the first bottom panel and the end panel.

28. The carrier of claim 16, wherein the carrier further comprises a handle comprising a finger hole extending in the top panel and one or more cutouts in the top gusset aligned with the finger hole.

29. A blank for forming a carrier for holding a plurality of articles, the blank comprising:

a plurality of panels comprising at least a top panel, a first bottom panel, a second bottom panel, and an end panel, wherein the end panel is for at least partially forming a closed end of the carrier formed from the blank;

a top gusset foldably connected to each of the top panel and the end panel; and a bottom gusset foldably connected to each of the first bottom panel and the end panel;

wherein the first bottom panel and the second bottom panel are for being secured together so that the first bottom panel and the second bottom panel at least partially form a bottom wall opposite to the top panel when the carrier is formed from the blank, the plurality of panels further comprises a side panel foldably connected to each of the top panel and the first bottom panel and a corner panel foldably connected to each of the end panel and the side panel, the corner panel is curved for extending along at least a portion of an article of the plurality of articles at a corner of the carrier formed from the blank.

30. The blank of claim 29, wherein the first bottom panel and the second bottom panel comprise locking elements for securing the first bottom panel and the second bottom panel together when the carrier is formed from the blank.

31. The blank of claim 29, wherein the first bottom panel comprises a locking edge or slit, and the second bottom panel comprises a locking tab projection, and wherein the locking edge or slit is for at least partially receiving the locking tab projection to secure the first bottom panel and the second bottom panel together when the carrier is formed from the blank.

32. The blank of claim 29, wherein the first bottom panel comprises a locking edge and a slit aligned along a longitudinal direction, and the second bottom panel comprises a primary locking tab projection and a secondary locking tab projection extending away from one another, and wherein the locking edge is for at least partially receiving the primary locking tab projection and the slit is for at least partially receiving the secondary locking tab projection to secure the first bottom panel and the second bottom panel together when the carrier is formed from the blank.

33. The blank of claim 29, wherein the top gusset comprises a central gusset panel foldably connected to a top gusset panel along an oblique fold line, the central gusset panel is foldably connected to the top panel along a longitudinal fold line, and the top gusset panel is foldably connected to the side panel along a lateral fold line.

34. The blank of claim 29, wherein the bottom gusset comprises a first bottom gusset panel foldably connected to a second bottom gusset panel along an oblique fold line, the first bottom gusset panel is foldably connected to the first bottom panel along a longitudinal fold line, and the second bottom gusset panel is foldably connected to the end panel along a lateral fold line.

35. The blank of claim 29, wherein the top gusset is foldably connected to the top panel along a first longitudinal fold line and to the end panel along a first lateral fold line, and the bottom gusset is foldably connected to the first bottom panel along a second longitudinal fold line and to the end panel along a second lateral fold line.

36. The blank of claim 29, wherein the end panel is a first end panel, and the blank further comprises a second end panel foldably connected to the top gusset, and wherein the first end panel and the second end panel are for cooperating to at least partially form the closed end of the carrier formed from the blank.

37. The blank of claim 36, wherein the bottom gusset is a first bottom gusset, and the blank further comprises a second bottom gusset foldably connected to each of the second bottom panel and the second end panel.

38. The blank of claim 37, wherein the blank further comprises a third end panel and a fourth end panel, a third bottom gusset foldably connected to each of the first bottom panel and the third end panel, and a fourth bottom gusset foldably connected to each of the second bottom panel and the fourth end panel.

39. The blank of claim 38, wherein the top gusset is a first top gusset, and wherein the blank further comprises a second top gusset foldably connected to each of the top panel, the third end panel, and the fourth end panel.

40. The blank of claim 29, wherein the blank further comprises at least one of an upper cutout extending along at least a portion of the top panel and the end panel and a lower cutout extending along at least a portion of the first bottom panel and the end panel.

41. A method of forming a package comprising a carrier holding a plurality of articles, the method comprising:

obtaining a blank comprising a plurality of panels comprising at least a top panel, a first bottom panel, a second bottom panel, and an end panel, a top gusset foldably connected to each of the top panel and the end panel, and a bottom gusset foldably connected to each of the first bottom panel and the end panel; and wrapping the blank at least partially around the plurality of articles to form the package, the wrapping the blank comprising:

positioning the end panel to at least partially form a closed end of the carrier; and securing the first bottom panel and the second bottom panel together to at least partially form a bottom wall of the carrier opposite to the top panel, the plurality of panels further comprises a side panel foldably connected to each of the top panel and the first bottom panel and a corner panel foldably connected to each of the end panel and the side panel, and the wrapping the blank further comprises positioning the corner panel to curve and extend along at least a portion of an article of the plurality of articles at a corner of the package.

42. The method of claim 41, wherein the first bottom panel and the second bottom panel comprise locking elements, and wherein the securing the first bottom panel and the second bottom panel together comprises engaging the locking elements of the first bottom panel and the second bottom panel.

43. The method of claim 41, wherein the first bottom panel comprises a locking edge or slit, and the second bottom panel comprises a locking tab projection, and wherein the securing the first bottom panel and the second bottom panel together comprises positioning the locking tab projection to be at least partially received in the locking edge or slit.

44. The method of claim 41, wherein the top gusset comprises a central gusset panel foldably connected to a top gusset panel, the central gusset panel is foldably connected to the top panel, and the top gusset panel is foldably connected to the side panel, and wherein the wrapping the blank further comprises folding the central gusset panel and the top gusset panel into an overlapping relationship during the positioning the end panel.

45. The method of claim 41, wherein the end panel is a first end panel, and the carrier further comprises a second end panel foldably connected to the top gusset, and wherein the positioning the end panel comprises positioning the first end panel and the second end panel to at least partially form the closed end of the carrier.

46. The method of claim 45, wherein the bottom gusset is a first bottom gusset, and the carrier further comprises a second bottom gusset foldably connected to each of the second bottom panel and the second end panel.

* * * * *